US006592689B2

(12) United States Patent
Hays

(10) Patent No.: US 6,592,689 B2
(45) Date of Patent: Jul. 15, 2003

(54) FRACTIONAL VARIATION TO IMPROVE BULK METALLIC GLASS FORMING CAPABILITY

(75) Inventor: Charles C. Hays, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 0 days.

(21) Appl. No.: 09/681,594

(22) Filed: May 3, 2001

(65) Prior Publication Data

US 2002/0053375 A1 May 9, 2002

Related U.S. Application Data

(60) Provisional application No. 60/201,586, filed on May 3, 2000.

(51) Int. Cl.[7] ..... C22C 45/10
(52) U.S. Cl. ..... 148/561; 420/423
(58) Field of Search ..... 148/403, 421, 148/561; 420/423

(56) References Cited

U.S. PATENT DOCUMENTS

| | | | | |
|---|---|---|---|---|
| 5,380,375 A | * | 1/1995 | Hashimoto et al. | 148/403 |
| 5,482,577 A | | 1/1996 | Hashimoto et al. | 148/403 |
| 5,735,975 A | * | 4/1998 | Lin et al. | 420/423 |
| 5,797,443 A | | 8/1998 | Lin et al. | 148/403 |

OTHER PUBLICATIONS

Eckert, J. et al. "Mechanically alloyed $Zr_{55}$ $Al_{10}$ $Cu_{30}$ $Ni_5$ metallic glass composites containing nanocrystalline W particles." *Journal of Applied Physics* (1999): 7112–1779.

Xing, L.Q. et al. "High–strength materials produced by precipitation of icosahedral quasicrystals in bulk Zr–Ti–Cu–Ni–Al amorphous alloys." *Applied Physics Letters* (1999): 664–666.

Xing, L.Q. et al. "Deformation mechanism of amorphous and partially crystallized alloys." *NanoStructured Materials* (1999):503–506.

Eckert, J. "Mechanical alloying of bulk metallic glass forming systems." *Materials Science Forum* (1999):3–12.

Schurack, F. et al. "Synthesis and properties of mechanically alloyed and ball milled high strength amorphous or quasicrystalline Al–alloys." *Materials Science Forum* (1999):49–54.

Kubler, A. et al. "Nanoparticles in an amorphous $Zr_{55}$ $Al_{10}$ $Cu_{30}$ $Ni_5$–matrix—the formation of composites by mechanical alloying." *Nanostructured Materials* (1999):443–446.

Eckert, J. et al. "Nanophase composites in easy glass forming systems." *NanoStructured Materials* (1999):439–442.

Schlorke, N. et al. "Properties of Mg–Y–Cu glasses with nanocrystalline particles." *NanoStructured Materials* (1999): 127–130.

Eckert, J. et al. "Mechanically alloyed Mg–based metallic glasses and metallic glass composites containing nanocrystalline particles." *Z. Metallkd 90* (1999):908–913.

Shingu, P.H. "Metastability of amorphous phases and its application to the consolidation of rapidly quenched powders." *Materials Science and Engineering* (1988):137–141.

* cited by examiner

*Primary Examiner*—George Wyszomierski
(74) *Attorney, Agent, or Firm*—Fish & Richardson P.C.

(57) ABSTRACT

Changing characteristics of relationships between components of a bulk metallic glass to stabilize one phase relative to another. A specific $Zr_{58.47}Nb_{2.76}Cu_{15.4}Ni_{12.6}Al_{10.37}$alloy is disclosed.

6 Claims, 2 Drawing Sheets

FRACTIONAL VARIATION TO IMPROVE BULK METALLIC GLASS FORMING CAPABILITY

CROSS REFERENCE TO RELATED APPLICATIONS

This application claims priority from provisional application No. 60/201,586 filed May 3, 2000.

BACKGROUND OF INVENTION

A glass is a material that when cooled from a heated liquid transforms to the solid state without forming crystals. Such non-crystallized materials are also called amorphous materials. For example, one of the better known amorphous materials is quartz, which can be used to form conventional window glass.

Most metals crystallize when they are cooled from the liquid state at reasonable rates, which causes their atoms to be arranged into a highly regular spatial pattern or lattice. A metallic glass is one in which the individual metal atoms have settled into an essentially random arrangement. Metallic glasses are not transparent like quartz glasses and are often less brittle than window glass.

A number of simple metal alloys may also be processed to form a glass-like structure. Binary metal alloys near deep eutectic features of the corresponding binary phase diagrams may be prepared into a glassy structure on cooling from the liquid state at rates greater than 1000 degrees per second. These binary metallic glasses may possess different properties than crystalline metals. These different properties may be useful in certain applications.

Bulk metallic glass forming alloys are a group of multicomponent metallic alloys that exhibit exceptionally high resistance to crystallization in the undercooled liquid state. Compared with the rapidly quenched binary metallic glasses studied prior to 1990, these alloys can be vitrified at far lower cooling rates, less than 10 degrees per second.

Many of the recently discovered bulk glass forming alloys can be broadly described as pseudo-ternary alloys of the form ETM1-x-yLTMxSMy. Typically the early transition metal couple, ETM, is a combination of elements from group IVB of the periodic table; e.g., Zr and Ti. The late transition metals, LTM, are typically combinations of the 3d transition metals from groups VIIIB and IB; e.g., Fe, Co, Ni, and Cu. The simple metal element, SM, is normally chosen groups from IIA or IIIA; e.g., Be, Mg or Al. However, the addition of a SM element is not a requirement for the formation of a bulk glass forming alloy.

Examples of some of the composition manifolds that contain ideal bulk metallic forming compositions are as follows: Zr—Ti—Cu—Ni—Be, Zr—Nb—Cu—Ni—Al, Ti—Zr—Cu—Ni, and Mg—Y—Cu—Ni—Li. There are also bulk metallic glass forming alloys based on magnesium.

Each of the chemical species and their combinations are chosen for a given alloy composition, such that the alloy composition lies in a region with low-lying liquidus surface. Alloy compositions that exhibit a high glass forming ability are generally located in proximity to deep eutectic features in the multicomponent phase diagram.

The glass forming ability of a given alloy is in part described by the critical cooling rate that is required to avoid a fraction of crystal which is either large enough to be detectable, or large enough to cause some change of property. The glass forming ability is generally considered higher if the alloy composition has a reduced glass transition temperature. The reduced glass transition temperature is defined as the ratio between the glass transition temperature $T_g$ to the liquidus temperature $T_{liq}$.

Early theoretical work on crystallization of undercooled liquid metals has showed that the nucleation rate was often vanishingly small for materials with $T_{rg}$ of approximately ⅔.

Bulk metallic glass alloys can be more easily formed if the eutectic like condition is satisfied. Many believe that the alloy should be close to a eutectic in order to obtain a high $T_{rg}$.

SUMMARY OF INVENTION

The present invention teaches that specific kinds of modifications in attributes of minor aspects of the chemical structure of certain bulk metallic glasses may change the properties of the glass structure in an unexpected way. Specifically, the constituents of the glass may be changed by an amount δ to change the glass forming capability.

Another aspect teaches a specific alloy of $Zr_{58.47}Nb_{2.76}Cu_{15.4}Ni_{12.6}Al_{10.37}$.

BRIEF DESCRIPTION OF DRAWINGS

These and other aspects of the invention will be described in detail with reference to the accompanying drawings, wherein.

DETAILED DESCRIPTION

Figure 1:
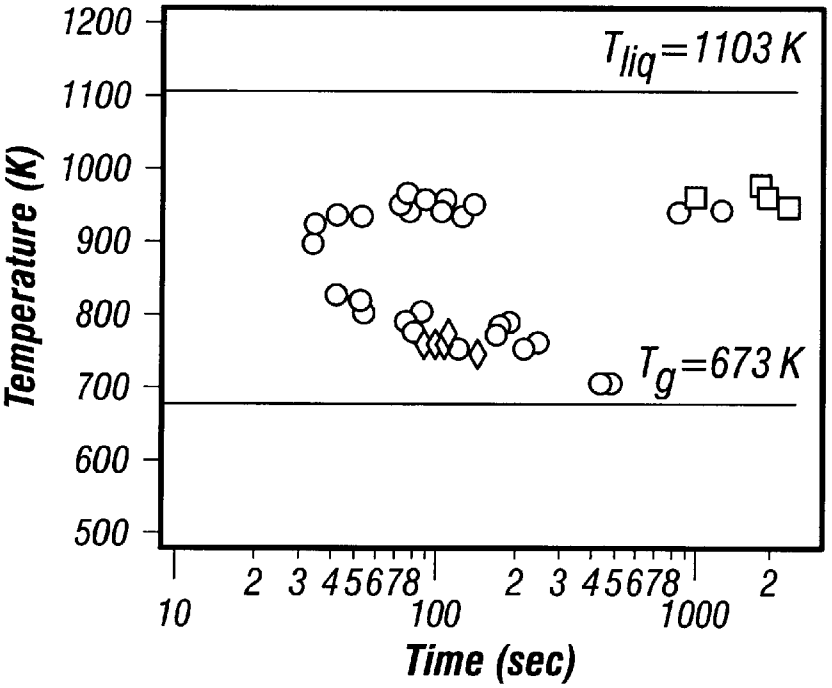
FIG. 1 shows a time-temperature-transformation diagram for the basic A3 alloy.

The present invention describes specific materials formed by carrying out small variations of component relationships, within the higher order basic chemical structure. This system and the disclosed technique describe how these small variations may stabilize the competing crystalline phases to form a bulk metallic glass which has improved qualities.

It is known to create a Zr—Nb—Cu—Ni—Al alloy bulk metallic glass by injecting the molten liquid metal into a split metal mold at room temperature. One example is the alloy $Zr_{57}Nb_5Cu_{15.4}Ni_{12.6}Al_{10}$, referred to herein as alloy A3. The A3 alloy exhibits a good glass forming ability, and also has excellent thermal stability with respect to crystallization. For example, this alloy has a supercooled liquid region a $\Delta T=T_x-T_g$ of about 70 degrees Kelvin, where Tg is the glass transition temperature, and Tx is the glass crystallization temperature. However, conventional techniques have not been very successful at vitrifying this alloy. Conventional metal forming techniques may cool from the liquid state to the solid state at less than 10K per second for specimens with masses that are greater than 5 g. Such conventional metal forming techniques may include arc melting on a water cooled Cu hearth, or melting in a "silver boat". Because of this, it has been relatively difficult to vitrify A3 alloy specimens using these conventional techniques.

The inventor questioned the reasons for this.

As stated earlier, several criteria are employed in the development of bulk metallic glasses; e.g., compositions are close to deep eutectics, and often exhibit large reduced glass transition temperatures. Closely tied to this condition is the role of the individual ETM and LTM constituents, and their combinatory effect on frustration of the competing crystalline phases which in turn limit the GFA for a given alloy composition. This destabilization of the crystalline phases that limit the GFA stems from fundamental considerations; e. g., the rules of Hume-Rothery. The first of these rules, the size factor, suggests that the solid solubility of one metal in another is restricted when their atomic radii differ by more that 15%. This criterion for extensive solid solubility is directly related to the strains produced in the lattice of the solvent by the solute atoms. In the ternary Zr—Ti-LTM, with LTM=Cu+Ni BMG alloys, there are only a few crystalline phases which act to limit the GFA for a given alloy composition. As it turns out, these phases have a rather global characteristic and are identified by x-ray diffraction measurements in specimens not fully vitrified on cooling from the liquid state. Examples of these are; ZrTiCu2 Ti2Cu, Zr2Cu, each with "E93" or MoSi2 symmetry. Outside critical ranges of solubility these competing crystalline phases are topologically unstable in comparison to a transition to the vitreous state. This important and salient feature that has been largely overlooked by the scientific community; i.e., the effect of small variations in composition within the higher order quinary (Zr—Nb—Cu—Ni—AL), and beyond composition manifold. In a systematic investigation, he considered the following additional chemical structure: $Zr_{57+60/2}Nb_{5-\delta}Cu_{15.4}Ni_{12.6}Al_{10+\delta/2}$ In this series, the effects of reducing the Nb concentration can be quantitatively considered. This equally sweeps the composition change to the ETM and LTM species.

One particular alloy composition, referred to as A3a, is the following: $Zr_{58.47}Nb_{2.76}\ Cu_{15.4}Ni_{12.6}Al_{10.37}$ δ may be around 2.5, or may be lower, e.g., lower than 1, or between 0.25 and 0.75.

Figure 2:
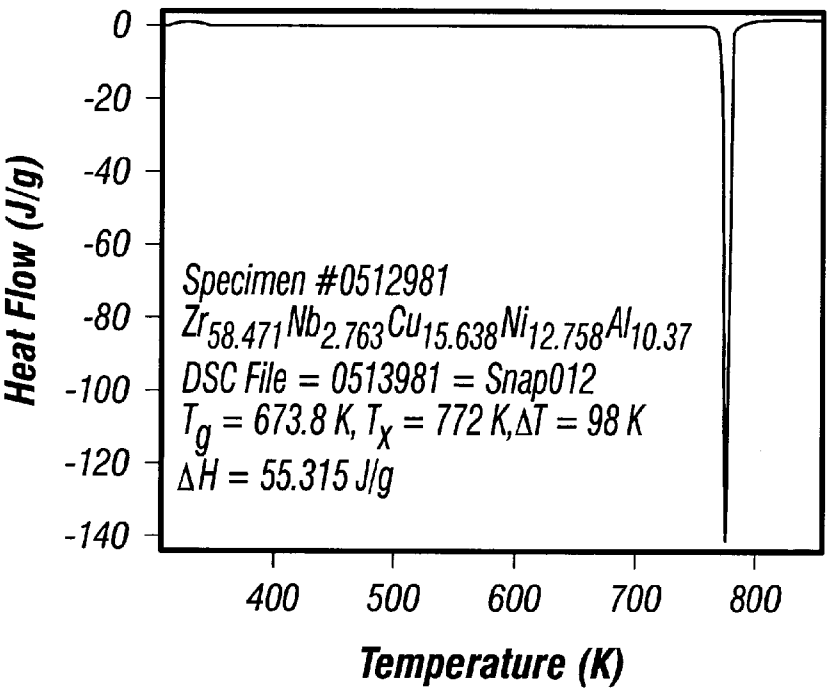
FIG. 2 shows a differential scanning calorimetry trace for the A3a alloy.
Figure 4:
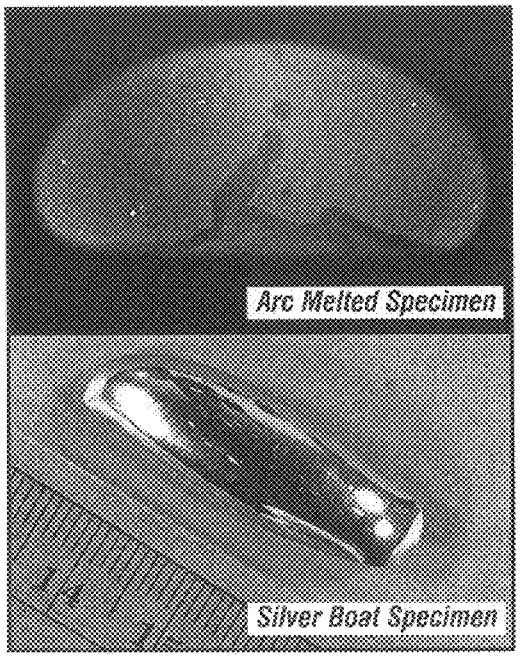
FIG. 4 shows arc melted specimens on a silver boat.

Characteristics of this material are shown in FIGS. 1 and 2. The A3a alloy specimens, when prepared by arc melting or melting in the silver boat assembly, are consistently formed into the glassy state on cooling. Representative images of the as-cast specimen cross section for an arc melted specimen and an entire silver boat specimen are shown in FIG. 4.

A3 alloy specimens were examined via a containerless levitation process. The information in FIG. 1, showing Time-Temperature-Transformation diagrams ("TTT") obtained from the examination. FIG. 1 shows the two independent nucleation events, including a "high temperature event", shown in circles, and a "low temperature event" shown in triangles. In order to bypass nucleation altogether, the "nose" of the lower nucleation curve must be bypassed.

This diagram suggests that a critical cooling rate in the order of 30 to 100 degrees Kelvin per second will be required to form a glass from this alloy. That is, one would be required to cross a temperature interval in the order of 100 K in the time scale of the order of a few seconds. This estimate has been confirmed via experimentation. Three specimens, with masses on the order of 5 to 10 grams, were used as experimentation; none of these samples were vitrified in an arc furnace.

FIG. 1 demonstrates that the glass forming ability of the A3 alloy may be limited by the presence of a competing phase or phases.

When written in its original form, the A3 composition has the following ratios.

$$\frac{Nb}{Zr} = 0.08772,\ \frac{Cu}{Ni} = 1.222,\ \frac{Cu+Ni}{Al} = 2.8$$

Consider the following additional chemical structure: $Zr_{57+\delta/2}Nb_{5-\delta}Cu_{15.4}Ni_{12.6}Al_{10+\delta/2}$ In this series, the effects of reducing the Nb concentration can be considered. This equally sweeps the composition change to the ETM and LTM species.

One particular alloy composition, referred to as A3a, is the following: $Zr_{58.47}Nb_{2.76}Cu_{15.4}Ni_{12.6}Al_{10.37}$, i.e., δ is some amount less than 1, e.g. between 0.25 and 0.75.

Characteristics of this material are shown in FIG. 2, which shows a differential scanning calorimetry "DSC" trace. This alloy has a dramatically improved glass formation ability. This material is relatively easily vitrified using standard techniques such as arc melting and melting on a water cooled silver boat apparatus. The critical casting thickness for this composition is near 1 cm. The calorimetrically determined supercooled liquid value ΔT is around 100 degrees K as shown in FIG. 2. Moreover, differential thermal analysis shows that the onset of melting for this alloy is a near eutectic composition. This is around 10 degrees K less than that of the A3 composition.

When examined using electrostatic limitation, this new alloy may be vitrified by purely radiative cooling. Hence, this becomes perhaps the first non Be containing alloy that can be vitrified upon free cooling from the electrostatic levitation. The critical cooling rate for this alloy may be less than 10 degrees K per second.

Figure 3:
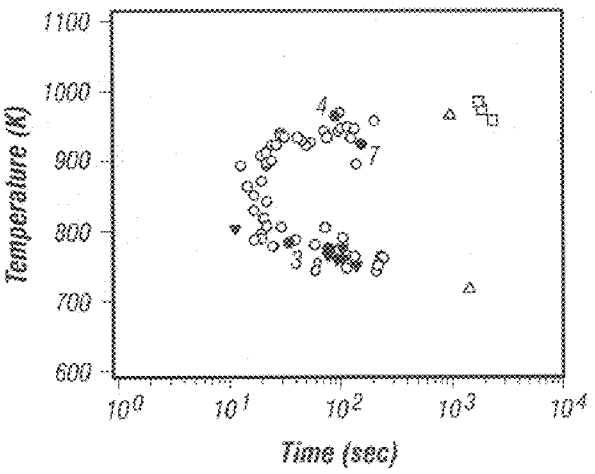
FIG. 3 shows a TTT diagram for the A3a alloy.

The TTT diagram for this alloy has also been determined and is shown in FIG. 3. This exhibits a single branch that is substantially in the state of a "C", having a nose time of about 10 seconds. The observed increase in the glass formation ability for this new alloy composition is manifest by the absence of high temperature branch characteristics. Since this high temperature branch has been removed, the competing crystalline phases responsible for the high temperature branch have been effectively de stabilized by incremental changes in composition. Ratios between the ETM, LTM and Al moieties of the A3a composition are given below, assuming the composition written as $Zr_{58.47}NB_{2.76}Cu_{15.64}Ni_{12.76}Al_{10.37}$ $$\frac{\mathrm{Nb}}{\mathrm{Zr}} = 0.0473,\ \frac{\mathrm{Cu}}{\mathrm{Ni}} = 1.226,\ \frac{\mathrm{Cu+Ni}}{\mathrm{Al}} = 2.740$$

The ratios as presented are shown with a large number of significant figures, e.g., 3–4 significant figures. This shows that the glass formation ability of these alloys may be dramatically changed for very small changes in the respective ratios. In fact, changes to the ratios may be important.

Note that the change in the ratio between Nb/Zr is different than in the A3 composition by about 1.855. The change in the Cu/Ni ratio may be more or less the same as is the Al ratios. The glass forming ability is more or less independent of the ratio between the Cu and Ni species. However, the ratio between Nb/Zr may be significant in this formation.

This formation is believed to be due to destabilization of a competing crystalline phase. The glass transition temperature ratio of this system, $T_{rg}$, is around 0.61.

Working example: The specific alloy $Zr_{58.47}NB_{2.76}Cu_{15.64}Ni_{12.76}Al_{10.37}$ was formed from Cu 99.999%, Ni 99.995%, Nb 99.95% from Cerac, Inc. and Al 99.999% from Alfa Aesar. It also used crystal bar Zr with less than 300 ppm oxygen content, obtained from Teledyne Wah-Chang, Inc. Master alloys are obtained by either arc melting using a turbomolecular pump in high purity argon (99.9999 percent), or melting on a water cooled silver boat apparatus with alloy constituents melted via an external RF power supply. Small pieces of the master alloy e.g. 35 to 60 milligrams of the master alloy's total 10 grams, are remelted into a hemispherical indentation on the base plate of the art melter. This produces a roughly spherical specimen of diameter ranging from 2 to 3 mm. These samples are then employed in in an electrostatic levitation device such as the one described in Rulison, Rev. Sci. Instrum. 68 (1997).

The thermal properties of the alloys were measured by a Perkin-Elmer DSC under an argon gas blanket. X-ray diffraction patterns were obtained with an INEL diffractometer using a CPS 120 position sensitive detector with a cobalt radiation source.

The A3a alloy specimens were consistently formed into the glassy state upon cooling.

The liquid is temperature is about 10 K lower then the basic A3. In addition, the following different characteristics were measured, where Vit 106 is alloy A3, and Vit 106a is alloy A3a.

TABLE 1

DSC and DTA data for Vit 106 and Vit 106a (specimen A).

| Data(K) | Vit 106 | Vit 106a |
|---|---|---|
| $T_g$ | 679 | 674 |
| $T_x$ | 752 | 772 |
| $\Delta T = (T_x - T_g)$ | 73 | 98 |
| $T_s$ | 1092 | 1082 |
| $T_{liq}$ | 1115 | 1106 |

Although only a few embodiments have been disclosed above, other modifications are possible. For example, while the present specification discloses a specific alloy made from modification of specific starting point, other such modifications are possible, and other starting points are contemplated.

All such modifications are intended to be encompassed within the following claims.

What is claimed is:

1. A method, comprising:

forming a bulk metallic glass comprising a non-Be alloy of Zr, Nb, Cu, Ni, and Al by stabilizing one of a plurality of phases of said non-Be alloy relative to another of said phases by adjusting a ratio of $$\frac{Nb}{Zr}$$

to about 0.0473, $$\frac{Cu}{Ni}$$

to about 1.226, and $$\frac{Cu + Ni}{Al}$$

to about 2.740, wherein the glass transition temperature ratio $T_{rg}$ is about 0.61.

2. The method of claim 1, wherein the non-Be alloy has the formulae $Zr_{57+\delta/2}Nb_{5-\delta}Cu_{15.4}Ni_{12.6}Al_{10+\delta 2}$, where δ is selected from the group consisting of between 2 and 3, between 0 and 1, and between 0.25 and 0.75.

3. A method as in claim 2, where δ is between 2 and 3.

4. A method as in claim 2, where δ is less than 1 but greater than 0.

5. A method as in claim 2, where δ is between 0.25 and 0.75.

6. The method of claim 2, wherein the non-Be alloy has the form $Zr_{58.47}Nb_{2.76}Cu_{15.4}Ni_{12.6}Al_{10.37}$.

* * * * *